US012135184B2

(12) United States Patent
Anselmo et al.

(10) Patent No.: US 12,135,184 B2
(45) Date of Patent: Nov. 5, 2024

(54) ARCHERY BOW RISER AND RELATED APPARATUSES

(71) Applicant: Hoyt Archery, Inc., Salt Lake City, UT (US)

(72) Inventors: Dan'l J. Anselmo, South Jordan, UT (US); Kevin T. Shamblen, West Jordan, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 7 days.

(21) Appl. No.: 17/969,014

(22) Filed: Oct. 19, 2022

(65) Prior Publication Data

US 2024/0133654 A1 Apr. 25, 2024
US 2024/0230271 A9 Jul. 11, 2024

(51) Int. Cl.
*F41B 5/10* (2006.01)
*F41B 5/14* (2006.01)

(52) U.S. Cl.
CPC ..... *F41B 5/10* (2013.01); *F41B 5/1403* (2013.01)

(58) Field of Classification Search
CPC .. F41B 5/10; F41B 5/1403; F41B 5/14; F41B 5/143; F41B 5/1484
USPC ..... 124/80, 32, 23.1, 25.6
See application file for complete search history.

(56) References Cited

U.S. PATENT DOCUMENTS 737,997 A * 9/1903 Burk ..... H02G 3/0608 174/97
5,934,267 A * 8/1999 Briner ..... F41B 5/14 124/88
9,032,946 B1 * 5/2015 Mathur ..... B29C 45/0005 124/25
2006/0011189 A1 * 1/2006 Simo ..... F41B 5/1426 124/44.5
2010/0043765 A1 * 2/2010 Lang ..... F41B 5/1403 124/88
2012/0042861 A1 * 2/2012 Anselmo ..... F41B 5/14 29/433
2012/0085331 A1 * 4/2012 Lang ..... F41B 5/10 124/88
2015/0153131 A1 * 6/2015 Trpkovski ..... F41B 5/0094 124/25.6
2015/0267998 A1 * 9/2015 Grace, Jr. ..... H10N 10/17 42/117
2019/0078857 A1 * 3/2019 Vergara ..... H10N 10/853
2019/0145728 A1 * 5/2019 White ..... F41B 5/1403 124/87
2020/0333102 A1 * 10/2020 Thalberg ..... F41B 5/1403
2021/0041203 A1 * 2/2021 McPherson ..... F41B 5/10

* cited by examiner

*Primary Examiner* — John E Simms, Jr.

(57) ABSTRACT

An archery bow can include a riser having first and second cavities that are in fluid communication to enable routing of one or more archery components through the riser. The riser can include a channel or groove formed within the riser. The channel has a size and shape that enables cable or wire to be removably retained within the channel and routed from one region of the riser to another region of the riser. The riser can include a conduit or passage that extends within the riser and enables one or more components to be routed within the riser.

16 Claims, 13 Drawing Sheets

ARCHERY BOW RISER AND RELATED APPARATUSES

TECHNICAL FIELD

The present disclosure generally relates to archery equipment and specifically relates to incorporating a conduit within archery bows and archery accessories.

BACKGROUND

Bowhunters and other archers use finely tuned archery equipment to launch arrows and other projectiles down range at one or more targets. This archery equipment can include an archery bow and one or more archery accessories, such as, one or more stabilizers, an arrow rest, a sight, a quiver, a combination thereof, or other archery accessories.

As electronic devices become increasingly smaller, lighter, and portable, there is a need for novel archery bow features which accommodate the use of one or more electronic devices coupled to the archer bow. For example, there remains a need for improving passing electronic signals from one region of the archery bow to another region of the archery bow.

Additionally, there remains a need for archery bows capable of reliably and unobtrusively retaining strings, cables, electronic archery accessories, and components thereof without negatively influencing the archer's ability to accurately use and carry the archery bow.

SUMMARY

One aspect of the present disclosure relates to a riser for an archery bow. The riser has a first portion, a second portion, and an intermediate portion disposed between the first portion and the second portion. The riser defines a shooting plane intersecting the intermediate portion. The intermediate portion includes a first surface defining a first aperture and a second surface defining a second aperture. The first aperture at least partially forms a first cavity within the riser. The first aperture intersects the shooting plane or is disposed below the shooting plane. The second aperture at least partially forms a second cavity within the riser. The first cavity and the second cavity are in fluid communication.

In some examples, the first surface is a forward-facing surface of the intermediate portion. In some examples, the second surface is a lateral-facing surface of the intermediate portion. The intermediate portion can include a third aperture formed within the second surface. The third aperture can at least partially form a third cavity. The second cavity and the third cavity can be in fluid communication by the first cavity. In some examples, the second aperture and the second cavity can define a through-hole extending through the intermediate portion. The riser can further include an electrically conductive wire extending into the first aperture, through the first cavity and the second cavity, and out of the second aperture. The electrically conductive wire can be configured to be used with an electronic accessory device of the archery bow. The intermediate portion can include a channel formed within the first surface and configured to retain an electrical cable.

Another aspect of the disclosure relates to an archery bow including a riser, a first limb, a second limb, and a bowstring. The riser includes a first portion, a second portion, and an intermediate portion. The intermediate portion includes a surface and a channel formed within the surface. The channel having sidewalls configured to releasably retain an electrical cable. The first limb is coupled to the first portion of the riser. The second limb is coupled to the second portion of the riser. The bowstring extends between the first limb and the second limb.

In some examples, a width of the channel varies with a depth of the channel. In some examples, the channel has a first width at a first depth from the surface; the channel has a second width at a second depth from the surface; and the first width is less than the second width. In some examples, at least a portion of the channel extends along an arcuate path.

Yet another aspect of the present disclosure relates to an archery bow including a riser, a first limb, a second limb, and a bowstring. The riser includes a composite material. The riser includes a first aperture, a second aperture, and a conduit formed between the first aperture and the second aperture. The first limb is coupled to the riser. The second limb is coupled to the riser. The bowstring extends between the first limb and the second limb.

In some examples, the riser includes an upper portion, a lower portion, and a handle portion disposed between the upper portion and the lower portion. The handle portion can include a first surface and a second surface. The first aperture and the second aperture can be formed within the first surface. In some examples, the riser includes an upper portion, a lower portion, and a handle portion disposed between the upper portion and the lower portion. The handle portion can include a first surface and a second surface. The first aperture can be formed within the first surface. The second aperture can be formed within the second surface.

In some examples, the conduit can be sized and shaped to receive at least a portion of an electrically conductive material. In some examples, the composite material can include carbon fiber. In some examples, the conduit can include a first section and a second section. The first section can extend substantially perpendicular relative to the second section. In some examples, the conduit can be wholly disposed within the riser.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1A:
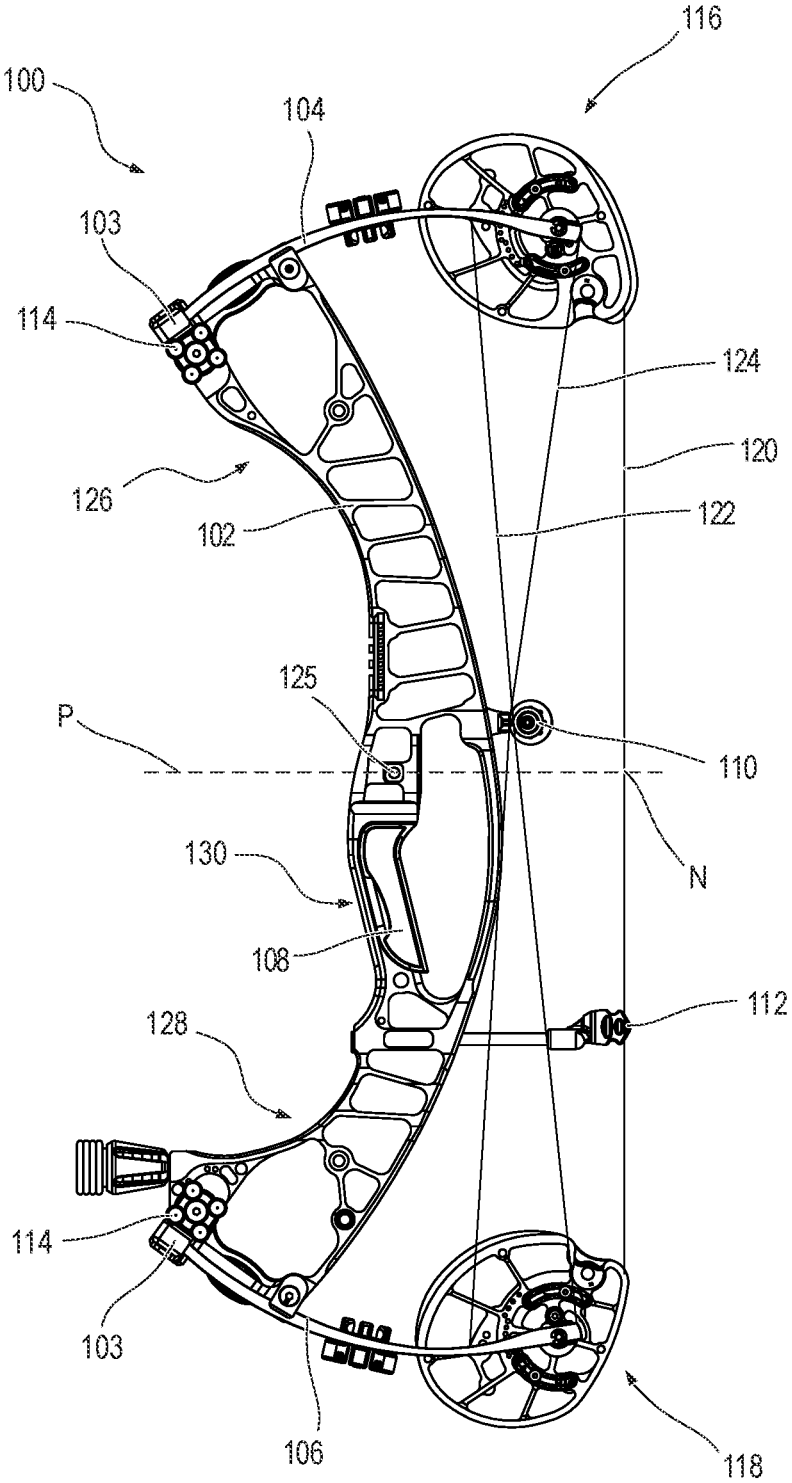
FIG. 1A is a side view of an archery bow.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

One aspect of the present disclosure generally relates to incorporating a plurality of cavities within an archery bow riser. Two or more of the plurality of cavities are in fluid communication such that a wire from an electronic device can be routed into one plane of the riser, through the cavities, and exit the cavities through another plane of the riser. This routing of the wire can minimize or prevent the wire from interfering with the archer's grip on or handling of the archery bow. Additionally, this routing can more reliably retain the wire to the archery bow. For example, this routing of the wire can occupy or utilize a greater length of the wire and thereby limit or prevent excess wire from extending beyond a periphery of the riser which risks the wire becoming entangled on objects within the shooting environment (e.g., tree limbs, the archer's equipment, etc.).

In some examples, a first surface can define a first plane of the riser and a second surface can define a second plane of the riser. The first plane can extend substantially perpendicular to the second plane. For example, the first plane can extend along a forward-facing surface of the riser and the second plane can extend along a lateral-facing or side surface of the riser. The first surface can define a first aperture while the second surface can define a second aperture. The first aperture can at least partially form or define a first cavity within the riser and the second aperture can at least partially form or define a second cavity within the riser. The first and second cavities are in fluid communication such that a wire, cable, or other component can be routed through the first and second cavities.

Another aspect of the present disclosure relates to one or more channels or grooves within one or more surfaces of the riser. The channels can be sized, shaped, and oriented to retain and route a component (e.g., a wire for an electronic device) from one region of the riser to another region of the riser. For example, the channel can continuously or intermittently extend between a forward-facing surface of the riser to a lateral-facing surface, a rearward-facing surface, or a combination thereof. In some examples, the channel can retain a wire or electrical cable placing an actuator or button into electrical communication with an archery accessory or other component of the archery bow having electronic functionality (e.g., an electronic archery sight). The wire can be partially or wholly disposed within the channel, for example, the channel may have a depth that only receives a portion of a width or diameter of the wire.

Another aspect of the present disclosure relates to forming or defining a conduit within a molded riser. For example, the riser can be formed or molded to include a conduit or passage that can accommodate a string, a cable, a wire, or an electrical cable therein. In some examples, an electrically conductive material can be disposed within the conduit to enable electrical communication between displaced or separated regions of the riser. In some examples, the conduit can be wholly disposed within the riser and can only be accessible by respective apertures formed on each end of the conduit. A wire, electrical cable, or electrically conductive material can form a signal path whereby electrical signals can be passed from one region of the riser to another region of the riser. Issues relating to entangling or mishandling the wire or cable can be prevented or limited by routing the wire or cable internally within the riser through the conduit.

The present description provides examples, and is not limiting of the scope, applicability, or configuration set forth in the claims. Thus, it will be understood that changes may be made in the function and arrangement of the cavities, conduits, channels, combinations thereof, and/or other elements of the archery bow discussed without departing from the spirit and scope of the disclosure, and various embodiments may omit, substitute, or add other procedures or components as appropriate. For instance, features described with respect to certain embodiments may be combined in other embodiments.

Referring now to the figures in detail, FIG. 1A shows a compound archery bow 100. The bow 100 is at a rest position (e.g., a brace state or brace position). The bow 100 can comprise a riser 102 from which one or more upper limbs 104 and one or more lower limbs 106 extend. For example, the upper limbs 104 can be affixed to the riser 102 by one or more limb pockets 103. The bow 100 can include a grip 108, a roller guard or cable guard 110, a string-stop damper 112, riser dampers 114, and other components.

The upper limbs 104 may be connected to an upper cam assembly 116, and the lower limbs 106 may be connected to a lower cam assembly 118. A bowstring 120 (i.e., draw string) may extend across the length of the bow 100 between the upper cam assembly 116 and the lower cam assembly 118. The terminal ends of the bowstring 120 may be attached to and held entrained to the cam assemblies 116, 118, at least in the brace position, and the limbs 104, 106 may be flexed to store energy and retain tension in the bowstring 120. A first cable 122 and a second cable 124 may also be attached to and extend between the upper cam assembly 116 and the lower cam assembly 118. Collectively, the first cable 122 and the second cable 124 may be referred to herein as the cables of the bow 100. The first and second cables 122, 124 may retain tension in the limbs 104, 106 and cam assemblies 116, 118 and may be controlled to adjust tension in the bowstring 120.

The figures illustrate example archery apparatuses that may be used in conjunction with the principles and teachings of the present disclosure. Thus, while the archery bows described herein are compound bows, it will be understood by those having ordinary skill in the art that the components of the archery bow, accessories, and related methods and apparatuses included in embodiments of the present disclosure may be applied to components and apparatuses in compound bows, recurve bows, crossbows, their accessories, and other equipment related to archery. Similarly, archery equipment applying the teachings of the present disclosure does not need to implement all of the features of the present disclosure. For example, in some embodiments, the bow may not comprise a cable guard 110 or a string-stop damper 112, so features associated with those accessories may be omitted from the bow 100.

When shooting an arrow, the tail end of the arrow may be nocked with the bowstring 120 at a nocking point N while the bow 100 is in the brace position shown in FIG. 1A. The bowstring 120 may be drawn rearward to a full draw position, thereby partially unwinding the bowstring 120 from the outer grooves of the cam assemblies 116, 118. The archer may grasp the grip 108 of the riser 102 and draw back the bowstring 120 (e.g., by using a D-loop, not shown). As the limbs 104, 106 flex inward and the cables 122, 124 wind around the cam assemblies 116, 118, the cables 122, 124 may slide along or may be in rolling contact with portions of the cable guard 110, which may comprise at least one roller or other smooth support in contact with the cables 122, 124 where they contact the cable guard 110. When the arrow is launched from the archery bow 100, the arrow can translate or move along a shooting plane P. In some examples, the shooting plane P can intersect the arrow nocking point N on the bowstring 120 and an aperture 125 in the riser 102 configured to couple an arrow rest to the riser 102 (e.g., a rest mount hole).

Figure 1B:
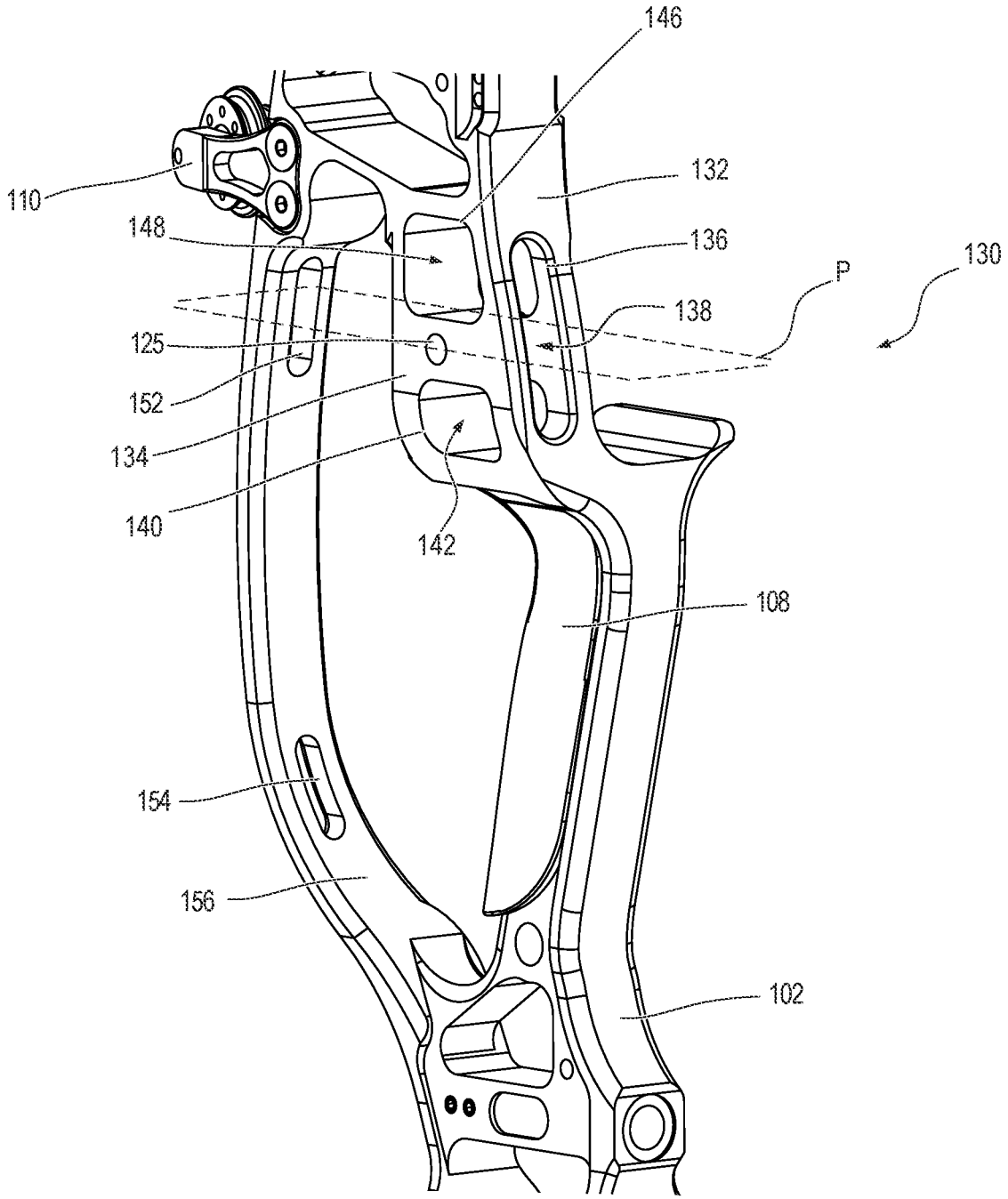
FIG. 1B is a perspective detail view of a handle portion of the archery bow, according to some embodiments.

In some examples, the riser 102 can include a first portion or an upper portion 126, a second portion or a lower portion 128, and an intermediate portion or a handle portion 130. FIG. 1B shows an example handle portion 130 of the riser 102. The example handle portion 130 depicted in FIG. 1B includes a first surface 132 and a second surface 134. The first surface 132 can be a forward-facing surface (i.e., a surface that faces downrange while the archery bow 100 is launching projectiles). The first surface 132 can define or form a first aperture 136 which at least partially defines or forms a first cavity 138. In some examples, the shooting plane P of the archery bow 100 can intersect the first cavity 138. In some examples, the first cavity 138 can be disposed below the shooting plane P (i.e., disposed between the shooting plane P and the lower portion 128 of the riser 102). Together, the first aperture 136 and the first cavity 138 can define a hole (e.g., a blind hole or a through-hole) within the first surface 132 of the handle portion 130 of the riser 102.

The second surface 134 can be a lateral-facing surface (i.e., a side surface of the riser 102). The second surface 134 can define or form a second aperture 140 which at least partially defines or forms a second cavity 142. In some examples, the shooting plane P of the archery bow 100 can intersect the second cavity 142. In some examples, the second cavity 142 can be disposed below the shooting plane P (i.e., disposed between the shooting plane P and the lower portion 128 of the riser 102). Together, the second aperture 140 and the second cavity 142 can define a hole (e.g., a blind hole or a through-hole) within the second surface 134 of the handle portion 130 of the riser 102.

In some examples, the first surface 132 and the second surface 134 can be perpendicular to one another. The first and second cavities 138, 142 can be in fluid communication with one another. In other words, the first cavity 138 and the second cavity 142 can enable a wire or electrical cable 144 to be inserted into the first aperture 136, extended through the first cavity 138 and into the second cavity 142, and exit the second cavity 142 through the second aperture 140 (see FIG. 1C). The fluid communication between the first cavity 138 and the second cavity 142 can enable a wire 144, cable, or other component to be routed through the riser 102 and limit or prevent routing the cable about a periphery of the riser 102 which can be undesirable.

Figure 1C:
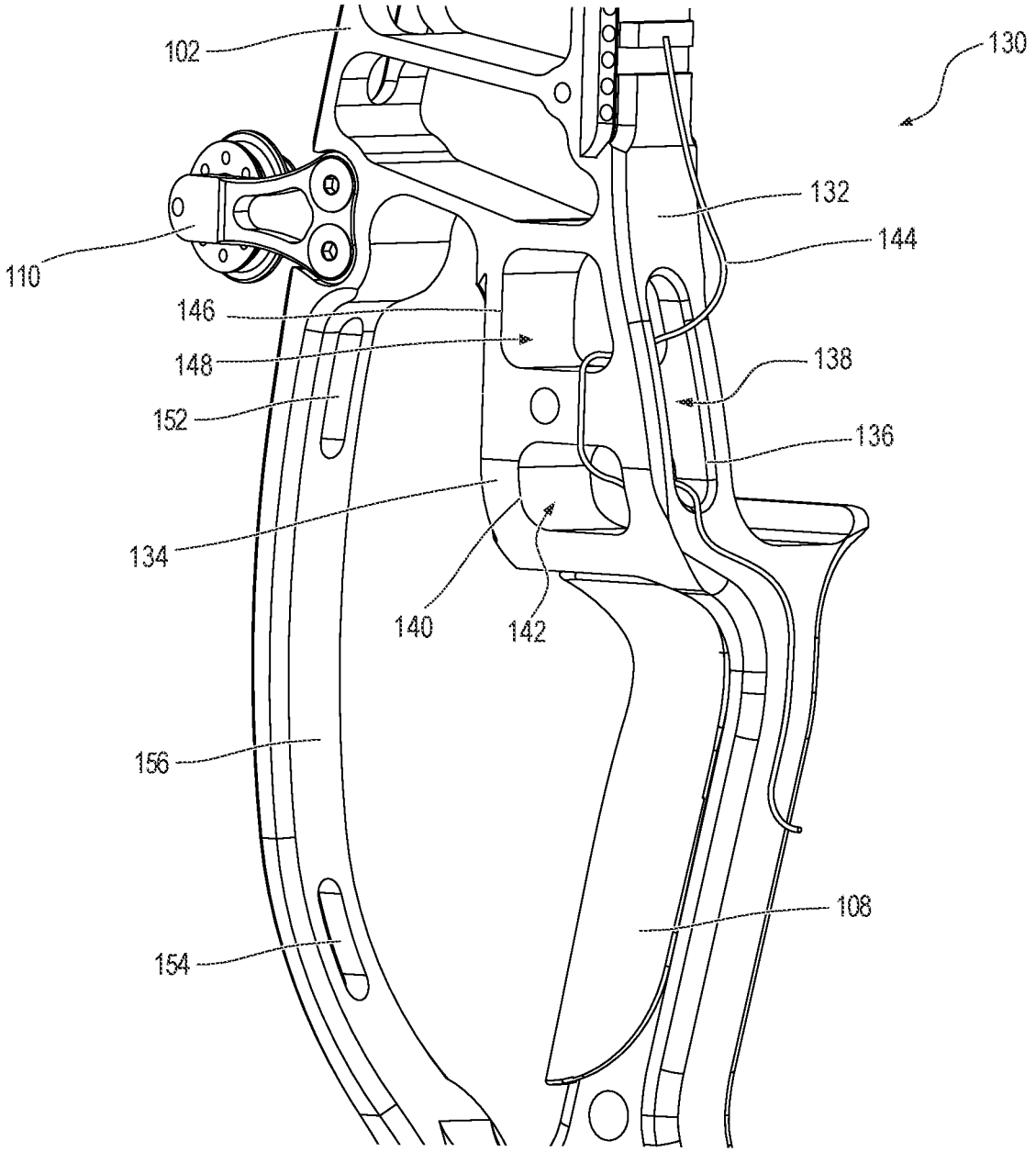
FIG. 1C is a perspective detail view of a handle portion of the archery bow, according to some embodiments.
Figure 1D:
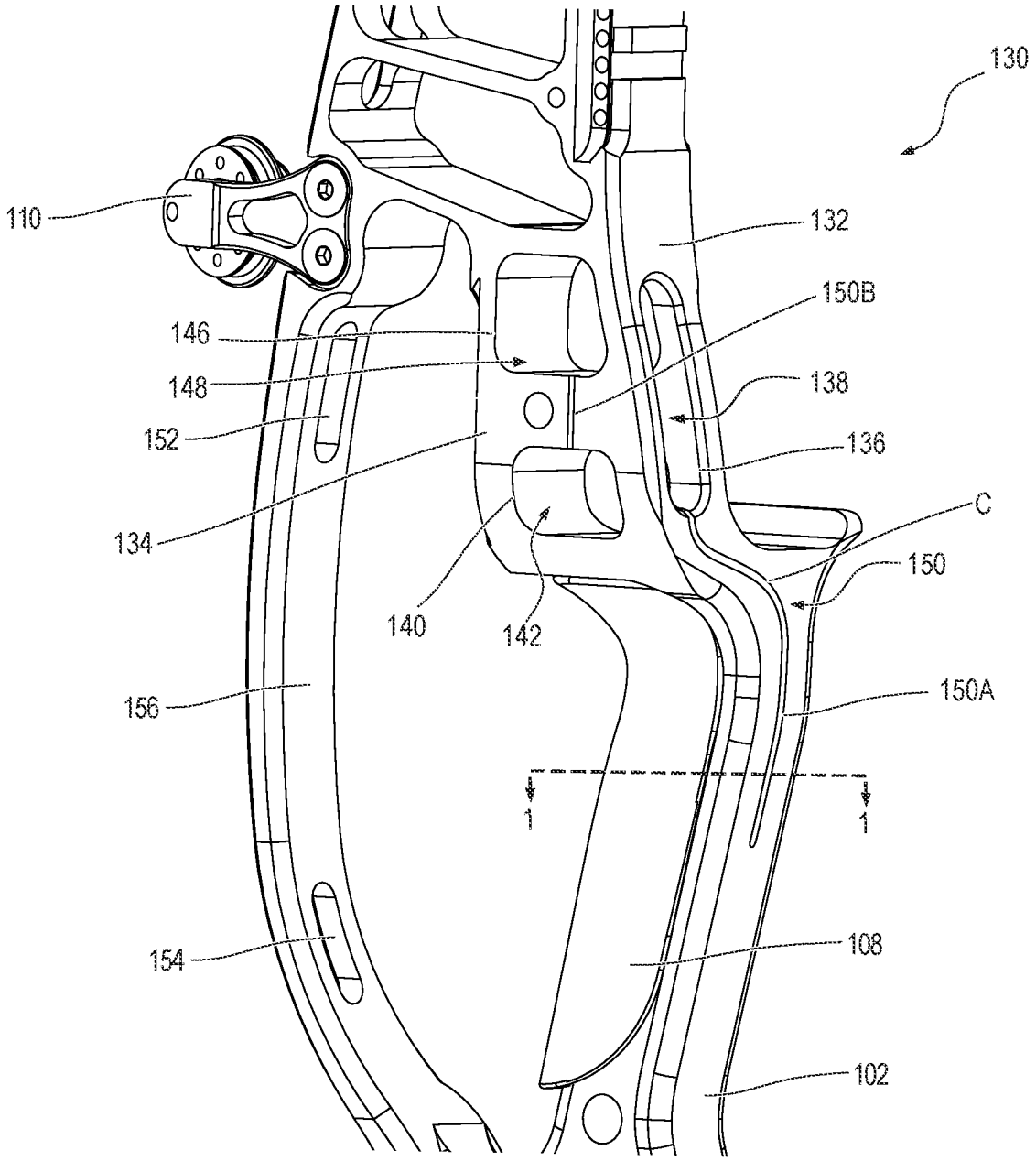
FIG. 1D is a perspective detail view of a handle portion of the archery bow, according to some embodiments.

In some examples, the second surface 134 can define or form a third aperture 146 which at least partially defines or forms a third cavity 148. In some examples, the shooting plane P of the archery bow 100 can intersect the third cavity 148. In some examples, the third cavity 148 can be disposed below the shooting plane P (i.e., disposed between the shooting plane P and the lower portion 128 of the riser 102). In some examples, the third cavity 148 can be disposed above the shooting plane P (i.e., disposed between the shooting plane P and the upper portion 126 of the riser 102). Together, the third aperture 146 and the third cavity 148 can define a hole (e.g., a blind hole or a through-hole) within the second surface 134 of the handle portion 130 of the riser 102. In some examples, the first, second, and third cavities 138, 142, 148 can be in fluid communication with one another. As shown in FIG. 1C, the fluid communication enables a wire 144 or other component can be routed through a combination of the first, second, and third cavities 138, 142, 148 and the first, second, and third apertures 136, 140, and 146.

As shown in FIGS. 1D-1G, in some examples, the riser 102 can include a groove or channel 150 having sections or portions 150A, 150B extending along one or more of the first surface 132, the second surface 134, a combination thereof, or any other surface of the riser 102. For example, the channel 150 can include a portion 150A that is formed within, and partially extends along, the first surface 132. Additionally, or alternatively, the channel 150 can include a portion 150B that is formed within, and partially extends along, the second surface 134. The channel 150 can receive and retain at least a portion of the wire 144 to retain the wire 144 in an unobstructive position relative to the handle portion 130 and the archer's grip about the handle portion 130. One or both of the portions 150A, 150B of the channel 150 can have linear or straight sections. Additionally, or alternatively, one or both of the portions 150A, 150B of the channel 150 can have curving or non-linear sections. For example, the portion 150A can include a bend or curve C such that a portion of the channel 150 retains the wire 144 in an arcuate path or route.

In some examples, the shooting plane P of the archery bow 100 (see FIGS. 1A and 1B) can intersect the channel 150, such as, intersecting the portion 150B. In some examples, the some or all of the channel 150 can be disposed below the shooting plane P. In some examples, the some or all of the channel 150 can be disposed above the shooting plane P.

Figure 1E:
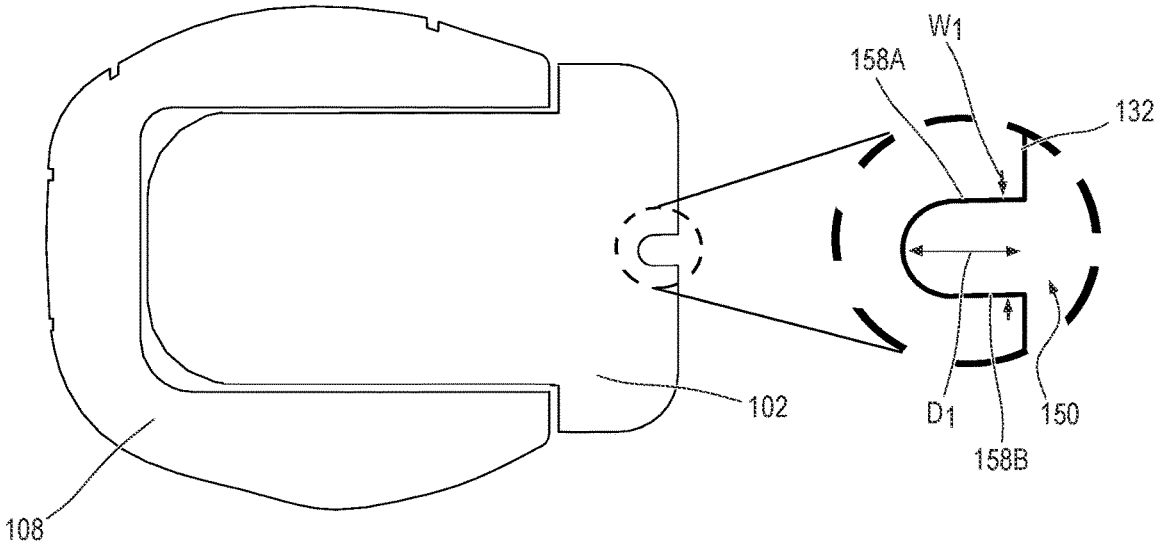
FIG. 1E an example cross-sectional view of a riser of the archery bow, according to some embodiments.
Figure 1F:
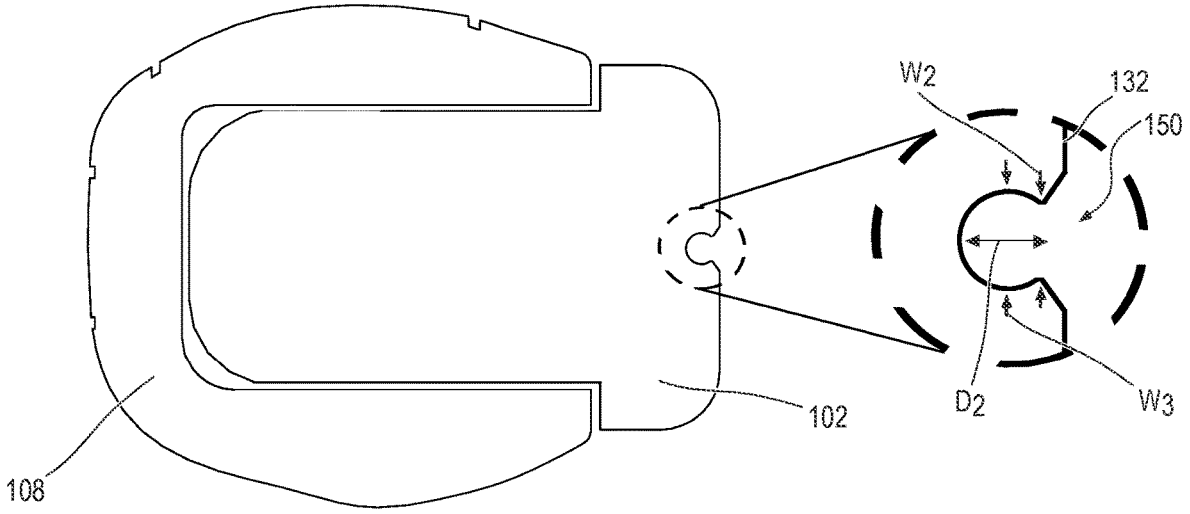
FIG. 1F an example cross-sectional view of a riser of the archery bow, according to some embodiments.
Figure 1G:
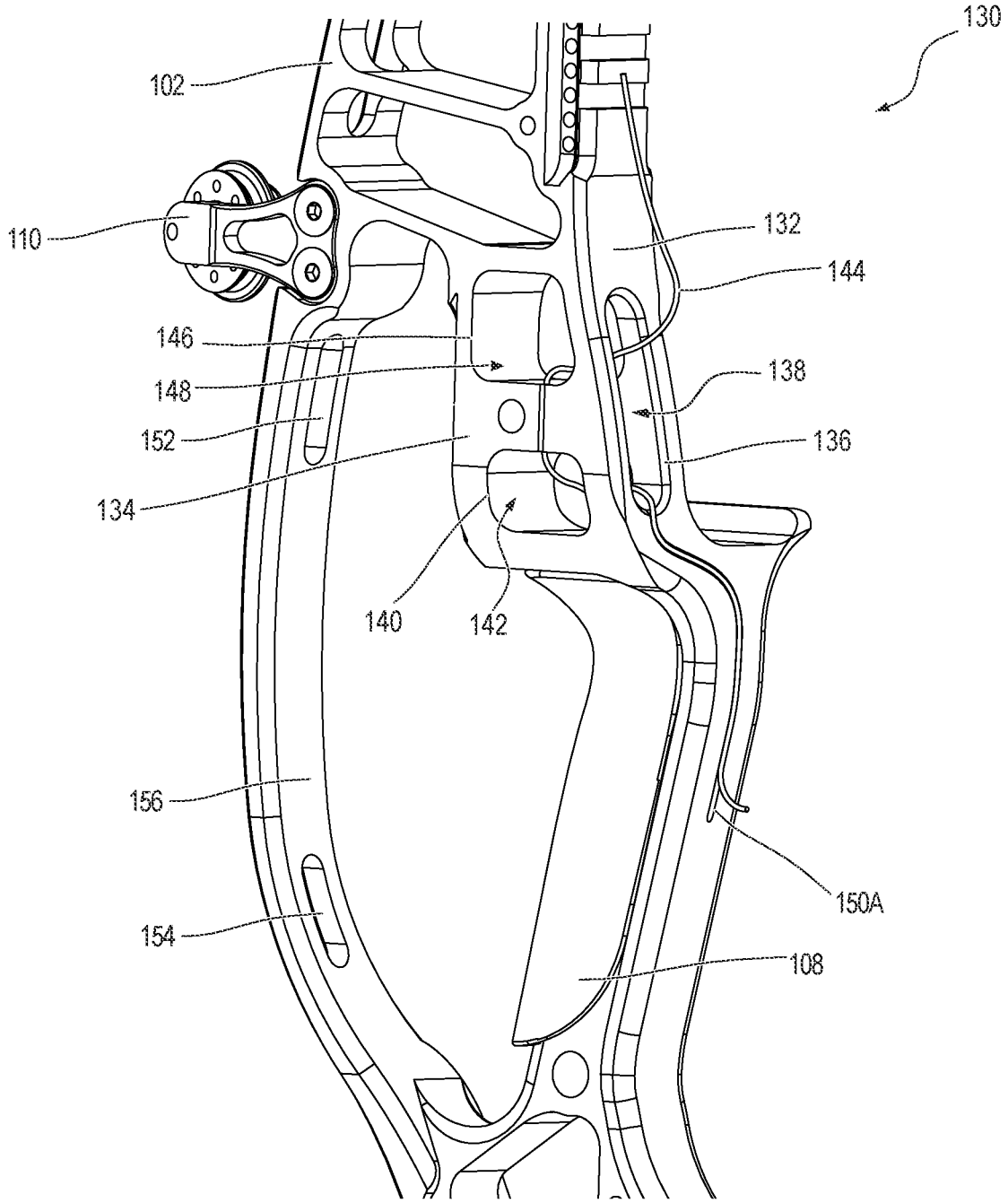
FIG. 1G is a perspective detail view of a handle portion of the archery bow, according to some embodiments.

In some examples, the wire 144 can place an actuator or button disposed on one end of the wire 144 into electrical communication with an archery accessory operably coupled to the other end of the wire 144. In some examples, the wire 144 can place a first electronic device operably coupled to one end of the wire 144 into electrical communication with a second electronic device operably coupled to the other end of the wire 144. As shown in FIG. 1E and FIG. 1F and described herein, the channel 150 can have a cross-sectional shape that retains the portion of the wire 144 within the channel 150. The wire 144 can be partially or wholly disposed within the channel 150, for example, the channel 150 may have a depth that accommodates all or a portion of a width or diameter of the wire 144. FIG. 1G shows the wire 144 disposed within, and routed along, the channel 150 to couple the wire 144 to the riser 102.

In some examples, the riser 102 can include one or more through-holes, slots, cut-outs, or other features that enable a cord, a rope, a string, a cable, or a tool to be threaded or routed through the riser 102. For example, the riser 102 can include a first slot 152 and a second slot 154 within a brace 156 of the handle portion 130. In some examples, a cord or cable of an archery accessory, such as an arrow rest (not shown), can be routed through the second slot 154 to operatively couple the archery accessory to another component of the archery bow 100 (e.g., the first cable 122).

FIG. 1E shows one example of a cross-sectional shape of the channel 150 within the riser 102. In some examples, the channel 150 can have a width $W_1$ at or near the first surface 132 that remains substantially constant over at least a portion of a depth $D_1$ of the channel 150. In some examples, the cross-sectional shape of the channel 150 (i.e., the width $W_1$ and/or the depth $D_1$) can be configured to retain an electrical cable (e.g., the wire 144) having a conductive metal wire encased in a non-conductive shielding. The width $W_1$ can be sized and shaped to contact and retain the electrical cable, for example, respective sidewalls 158A, 158B of the channel 150 can provide a compressive force on the electrical cable to retain the electrical cable within the channel 150. In some examples, a portion of the channel 150 can taper or curve. For example, the respective sidewalls 158A, 158B can curve at a constant radius to form a half-circle cross-sectional shape at the depth $D_1$. In some examples, each respective sidewall 158A, 158B can be planar and can be spaced apart by the width $W_1$ over the entirety of the depth $D_1$ to form a square or rectangular cross-sectional shape.

FIG. 1F shows another example of a cross-sectional shape of the channel 150 within the riser 102. In some examples, the cross-sectional shape can have a width that varies over at least a portion of a depth $D_2$ of the channel 150. For example, the channel 150 can have a first width $W_2$ at or near the first surface 132 and the channel 150 can have a second width $W_3$ at a location displaced from the first surface 132. The first width $W_2$ can be different from the second width $W_3$. For example, as shown in FIG. 1F, the first width $W_2$ can be less than the second width $W_3$. In some examples, the cross-sectional shape of the channel 150 can be configured to retain an electrical cable (e.g., the wire 144) having a conductive metal wire encased in a non-conductive shielding. For example, the first width $W_2$ can be less than a diameter of the electrical cable such that the electrical cable can be removably retained within the channel 150. In some examples, the second width $W_3$ is substantially equivalent to the diameter of the electrical cable.

While respective channels and cavities are shown in FIGS. 1A-1G in a certain configuration, this disclosure contemplates any combination of channels and cavities utilized within a single riser of an archery bow. Moreover, the specific implementations of channels and cavities shown in FIGS. 1A-1G should not be construed as limiting to the aspects disclosed herein. Rather, the embodiments shown in FIGS. 1A-1G represent example embodiments out of many possible ways to arrange one or more channels and/or cavities within a riser of an archery bow.

Figure 2A:
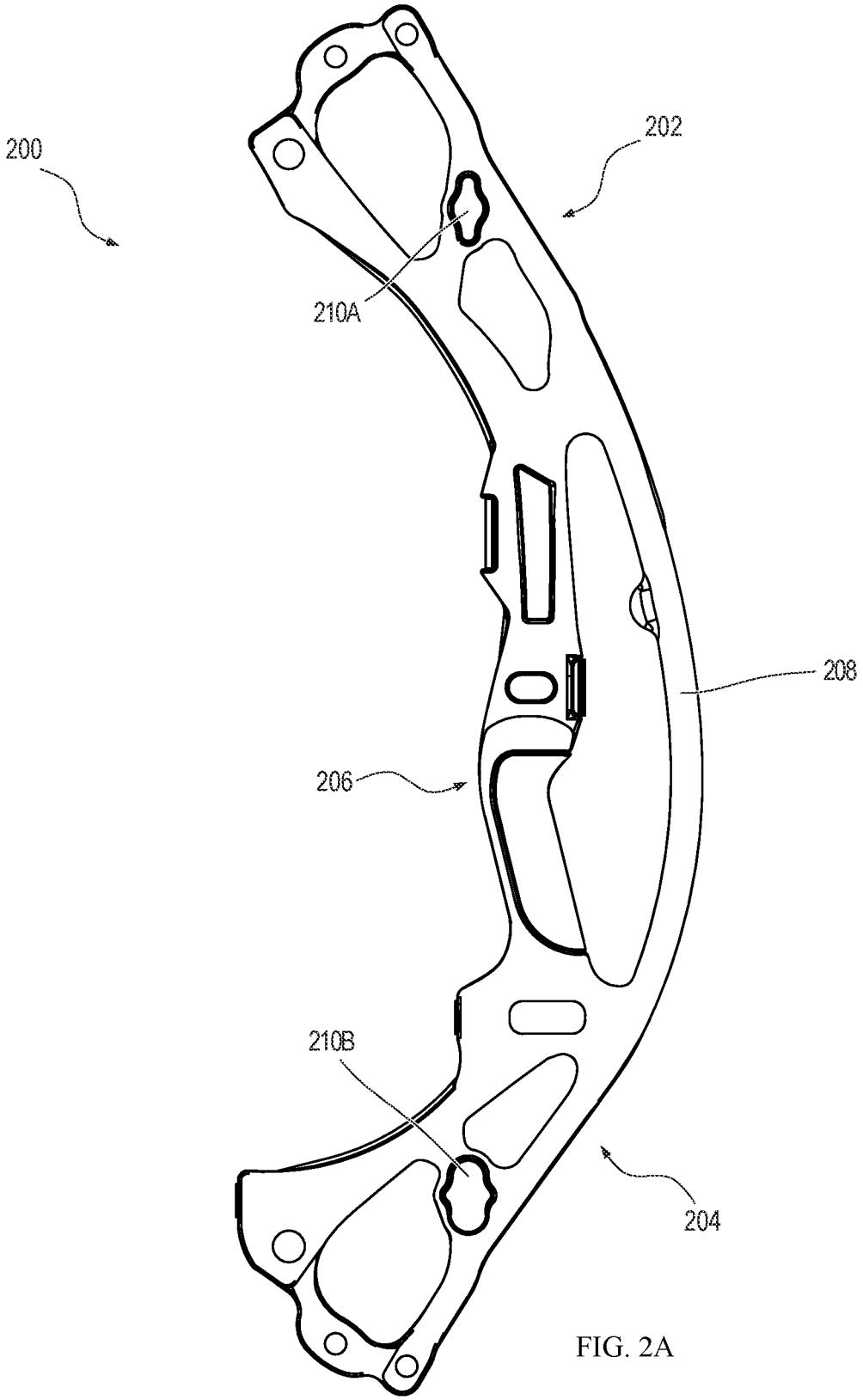
FIG. 2A is a side view of a riser for an archery bow, according to some embodiments.

FIG. 2A shows a riser 200 for an archery bow. The riser 200 can include a first portion or an upper portion 202, a second portion or a lower portion 204, and an intermediate portion or a handle portion 206. In some examples, the riser 200 can include a brace 208 extending from the upper portion 202 to the lower portion 204. In some examples, the riser 200 can be molded or formed from a moldable or flowable material. For example, the riser 200 can be formed from a composite material (carbon fiber, fiber glass, etc.), a flowable alloy (e.g., magnesium, aluminum, etc.), a flowable fiber (e.g., long fiber injection), a combination thereof, or any other moldable and/or formable material. Machined or molded components can be adhered, fastened, or otherwise affixed to the riser 200. For example, the riser 200 can include one or more inserts 210A, 210B coupled to the riser 200.

Figure 2B:
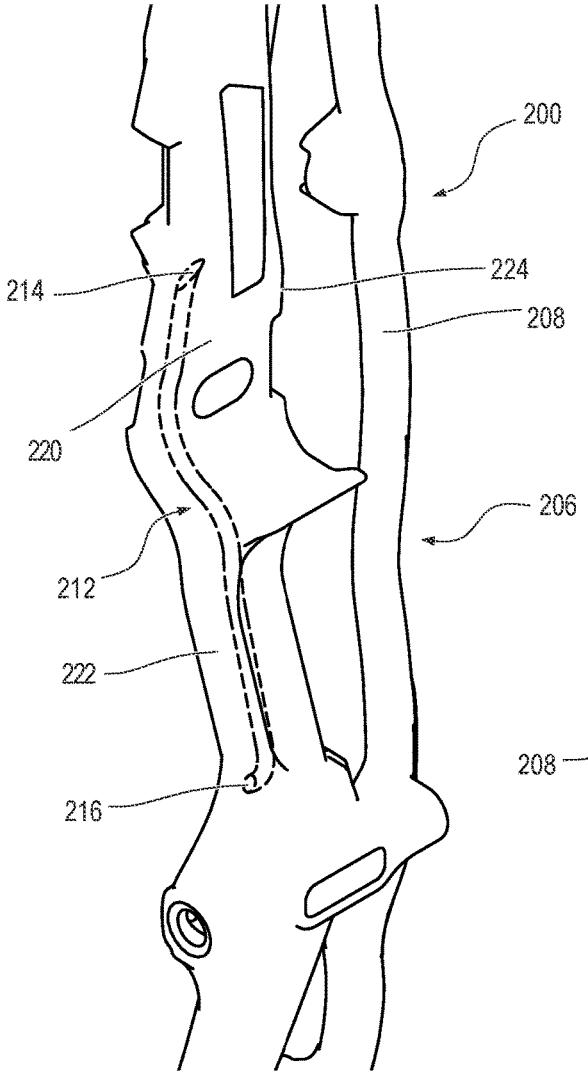
FIG. 2B is a perspective side view of the riser for an archery bow, according to some embodiments.
Figure 2C:
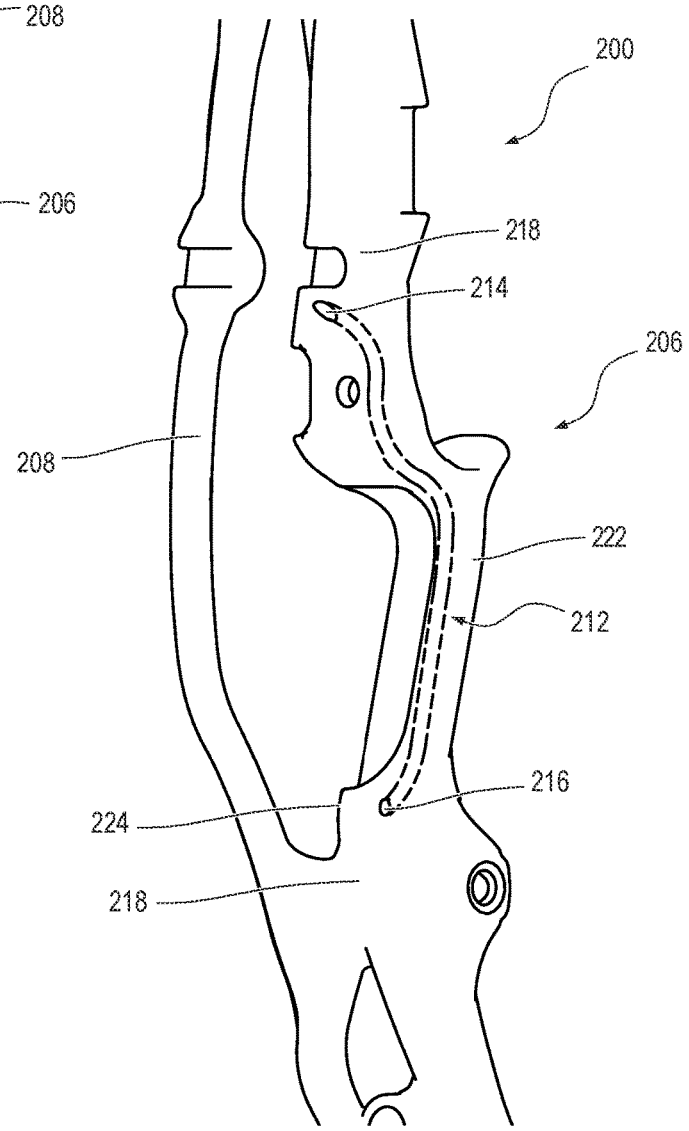
FIG. 2C is a perspective side view of the riser for an archery bow, according to some embodiments.

FIGS. 2B and 2C show respective side views of a conduit 212 extending within the riser 200. More specifically, the conduit 212 is formed within the handle portion 206 of the riser 200. That is, at least a portion of the conduit 212 can be wholly disposed within the handle portion 206. The conduit 212 can extend between a first aperture 214 and a second aperture 216. The first aperture 214 can be formed or defined within a first surface 218 (e.g., a lateral-facing surface of the riser 200). The second aperture 216 can also be formed or defined within the first surface 218. In some examples, the first aperture 214 can be formed or defined within a different surface of the riser 200 than the second aperture 216. For example, the first aperture 214 can be formed or defined within the first surface 218 while the second aperture 216 can be formed or defined within a different lateral-facing surface 220, a forward-facing surface 222, or a rearward-facing surface 224 of the riser 200.

The conduit 212 can be an open channel or passage that extends from one region or area of the riser 200 to another region or area of the riser 200. The conduit 212 can be sized and shaped to receive one or more cables, strings, wires, a combination thereof, or other components. For example, the conduit 212 can be sized and shaped to receive a wire or electrical cable (see wire 144) that carries or passes an electrical signal from one region of the riser 200 to another region. In some examples, a user (e.g., a manufacturer, an archer, an archery shop employee, etc.) can insert a wire, a string, a cable, or another component into the first aperture 214 and feed the component through the conduit 212 until the component exits the conduit 212 through the second aperture 216.

The conduit 212 can hide, conceal, and retain at least a portion of the component within the riser 200 to limit interaction between the component and other objects within the shooting environment. For example, the component can be a wire that extends through the conduit from one region of the handle portion 206 to another region of the handle portion 206. Some or all of the wire can be housed within the conduit 212 such that the archer's hand does not come into contact with the wire despite the wire extending along the handle portion 206. In this manner, the wire can be retained within the conduit 212 and limit or prevent the wire from entangling on external objects or causing discomfort to the archer by acting as an obstruction or hindrance to the archer.

The conduit 212 can extend substantially straight or linearly in some examples. In other examples, the conduit 212 can include sections that are curved, twisted, bent, or otherwise nonlinear. In some examples, the conduit 212 can include respective sections that are arranged perpendicular or substantially perpendicular to one another. In some examples, the conduit 212 can be branched such that more than two apertures 214, 216 are placed in fluid communication by the conduit 212.

In some examples, the conduit 212 can be permanently filled with an electrically conductive material, such as a metal, to form an electrically conductive path that is integrated within the riser 200 and accessible or available via the first and second apertures 214, 216 now filled with electrically conductive material. In some examples, the electrically conductive material can be positioned within a mold and the riser 200 can be formed or molded around the electrically conductive material such that the riser 200 does not require a conduit or passage (e.g., the conduit 212). Rather, the electrically conductive material can be integrally formed or disposed within the riser 200.

Figure 3A:
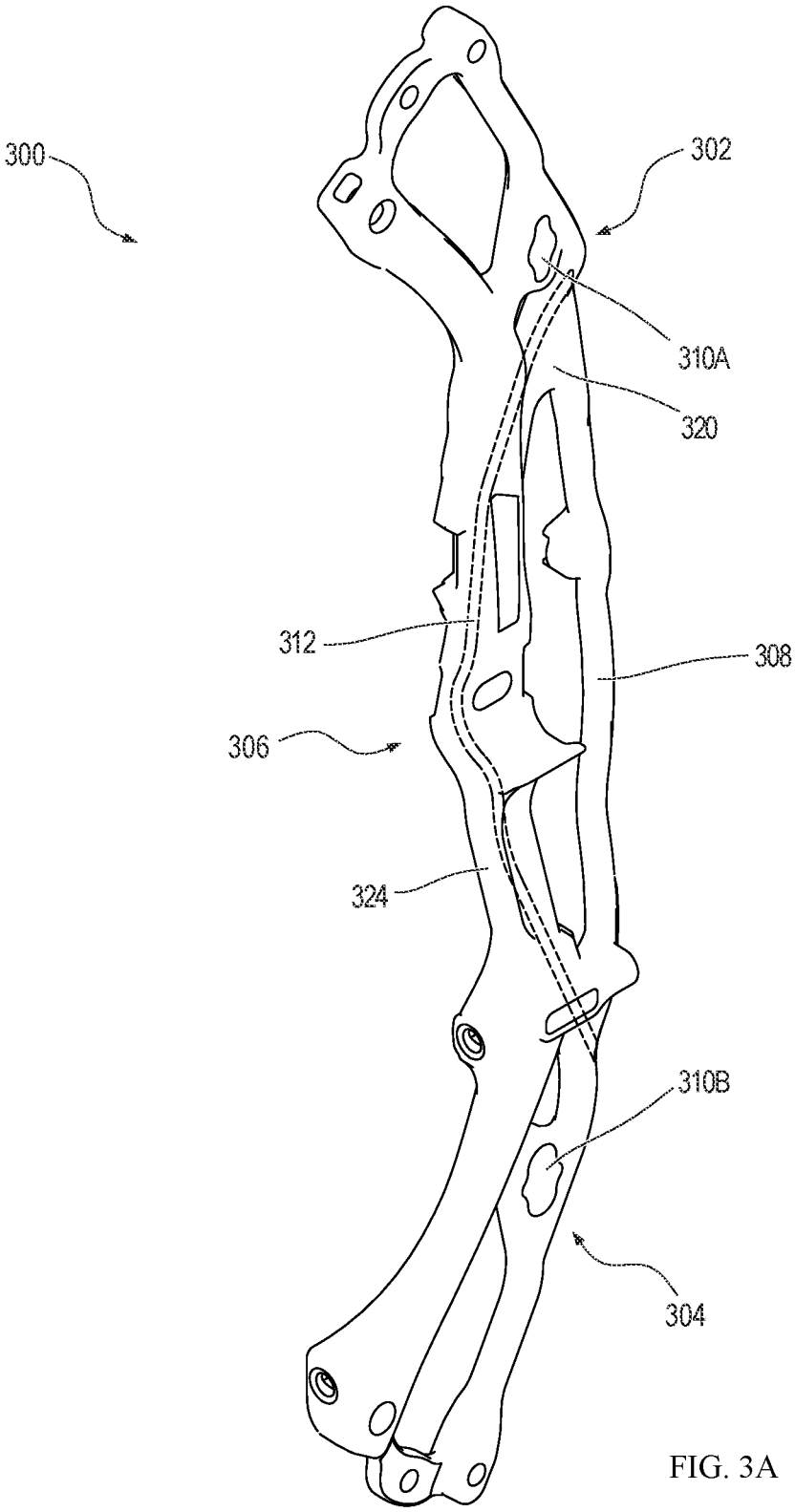
FIG. 3A is a perspective side view of a riser for an archery bow, according to some embodiments.
Figure 3B:
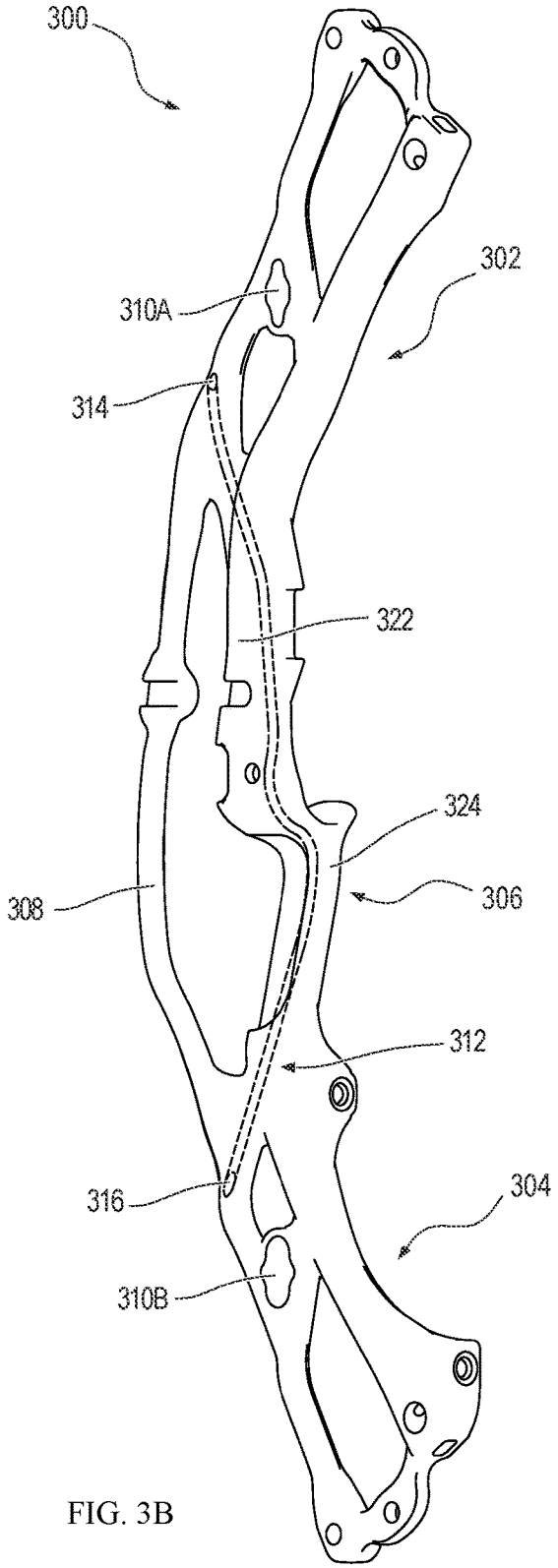
FIG. 3B is a perspective side view of the riser for an archery bow, according to some embodiments.
Figure 3C:
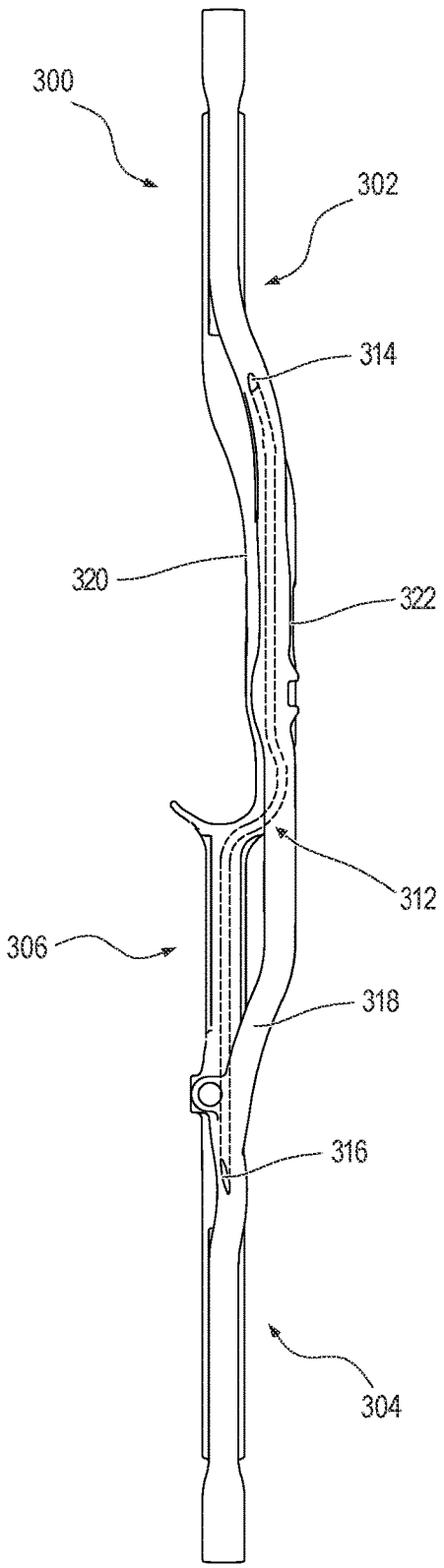
FIG. 3C is rear view of the riser for an archery bow, according to some embodiments.

FIGS. 3A-3C show respective views of a riser 300 for an archery bow. The riser 300 can include a first portion or an upper portion 302, a second portion or a lower portion 304, and an intermediate portion or a handle portion 306. In some examples, the riser 300 can include a brace 308 extending from the upper portion 302 to the lower portion 304. The riser 300 can be substantially similar to, and can include some or all of, the features of the riser 200. For example, the riser 300 can be molded or formed from a moldable or flowable material. Machined or molded components can be adhered, fastened, or otherwise affixed to the riser 300. For example, the riser 300 can include one or more inserts 310A, 310B coupled to the riser 300.

The riser 300 can include a conduit 312 having sections within one or more of the upper portion 302, the handle portion 306, the brace 308, and the lower portion 304. For example, as shown in FIGS. 3A-3C, the conduit 312 can extend from the upper portion 302, through the handle portion 306, and into the lower portion 304. In some examples, the conduit 312 can be formed or defined within a hollow tube. In other words, the conduit 312 can be formed within a portion or entirety of one hollow tube of a plurality of hollow tubes that form the riser 300. In some examples, the conduit 312 can be formed or defined as a void within a structure, such as, a composite carbon structure. The riser 300 can be formed from a composite material (carbon fiber, fiber glass, etc.), a flowable alloy (e.g., magnesium, aluminum, etc.), a flowable fiber (e.g., long fiber injection), a combination thereof, or any other moldable and/or formable material.

The conduit 312 can extend between a first aperture 314 and a second aperture 316. The first aperture 314 can be formed or defined within a rearward-facing surface 318 of the riser 300. The second aperture 316 can also be formed or defined within the rearward-facing surface 318. In some examples, the first aperture 314 can be formed or defined within a different surface of the riser 300 than the second aperture 316. For example, the first aperture 314 can be formed or defined within the rearward-facing surface 318 while the second aperture 316 can be formed or defined within a lateral-facing surface 320, 322, or a forward-facing surface 324 of the riser 300.

The conduit 312 can be an open channel or passage that extends from one region or area of the riser 300 to another region or area of the riser 300. The conduit 312 can be sized and shaped to receive one or more cables, strings, wires, a combination thereof, or other components. For example, the conduit 312 can be sized and shaped to receive a cable (e.g., one or more of the cables 122, 124) that is operably connected to another component of the archery bow. Internally routing one or more cables within the conduit 312 can protect portions of the cable from wear, improve aerodynamics of the archery bow, and many other advantages. In some examples, a user (e.g., a manufacturer, an archer, an archery shop employee, etc.) can insert the cable into the first aperture 314 and feed the component through the conduit 312 until the component exits the conduit 312 through the second aperture 316. Additionally, or alternatively, the conduit 312 can be sized and shaped to receive a wire or electrical cable (see wire 144) that carries or passes an electrical signal from one region of the riser 300 to another region, as described herein with reference to FIGS. 2B and 2C.

Figure 4A:
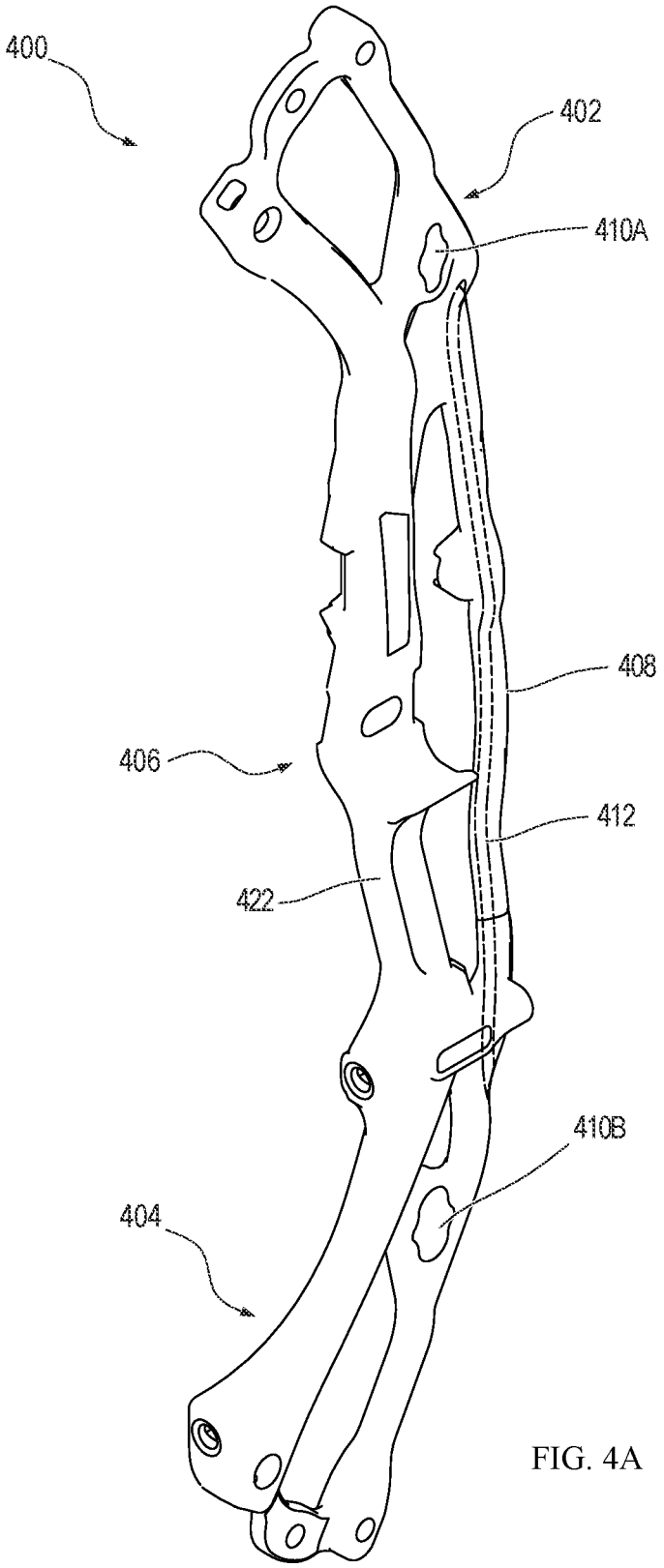
FIG. 4A is a perspective side view of a riser for an archery bow, according to some embodiments.
Figure 4B:
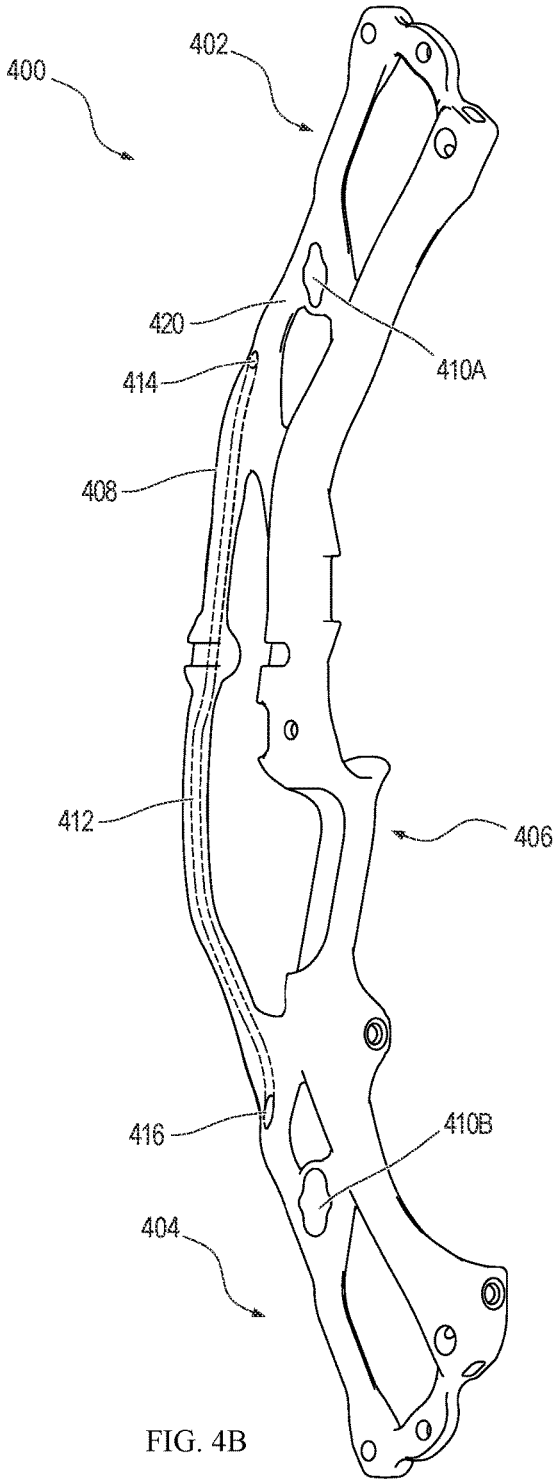
FIG. 4B is a perspective side view of the riser for an archery bow, according to some embodiments.
Figure 4C:
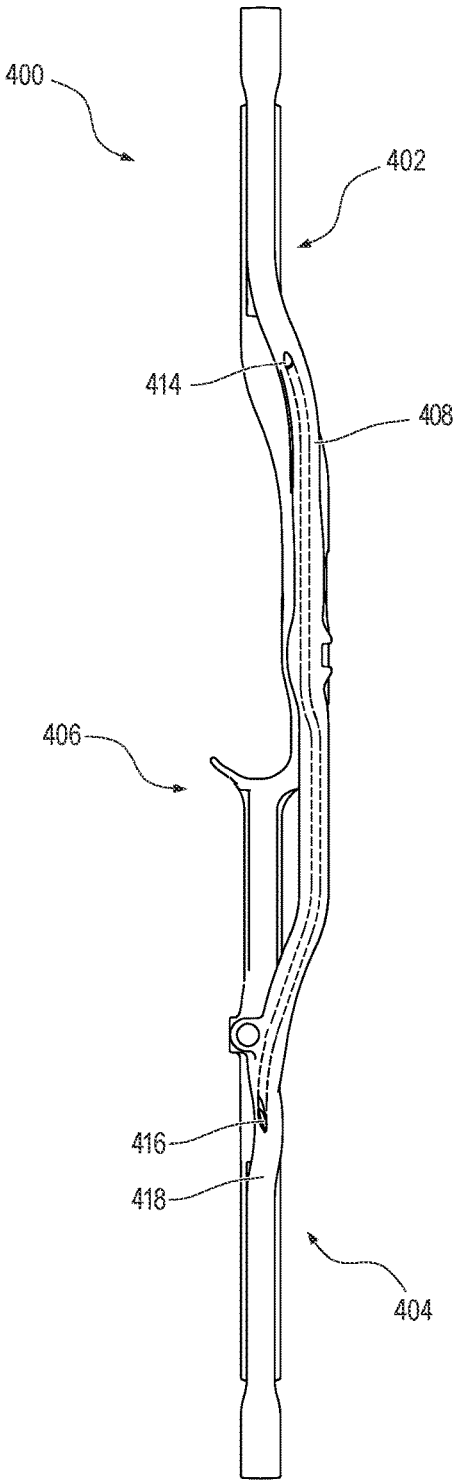
FIG. 4C is rear view of the riser for an archery bow, according to some embodiments.

FIGS. 4A-4C show respective views of a riser 400 for an archery bow. The riser 400 can include a first portion or an upper portion 402, a second portion or a lower portion 404, and an intermediate portion or a handle portion 406. In some examples, the riser 400 can include a brace 408 extending from the upper portion 402 to the lower portion 404. The riser 400 can be substantially similar to, and can include some or all of, the features of the risers 200, 300. For example, the riser 400 can be molded or formed from a moldable or flowable material. Machined or molded components can be adhered, fastened, or otherwise affixed to the riser 400. For example, the riser 400 can include one or more inserts 410A, 410B coupled to the riser 400.

The riser 400 can include a conduit 412 having sections within one or more of the upper portion 402, the brace 408, and the lower portion 404. For example, as shown in FIGS. 4A-4C, the conduit 412 can extend from the upper portion 402, through the brace 408, and into the lower portion 404. In some examples, the conduit 412 can be formed or defined within a hollow tube. In other words, the conduit 412 can be formed within a portion or entirety of one hollow tube of a plurality of hollow tubes that form the riser 400. For example, the brace 408 can be made from a hollow tube and the conduit 412 can extend through the hollow tube. In some examples, the conduit 412 can be formed or defined as a void within a carbon structure.

The conduit 412 can extend between a first aperture 414 and a second aperture 416. The first aperture 414 can be formed or defined within a rearward-facing surface 418 of the riser 400. The second aperture 416 can also be formed or defined within the rearward-facing surface 418. In some examples, the first aperture 414 can be formed or defined within a different surface of the riser 400 than the second aperture 416. For example, the first aperture 414 can be formed or defined within the lateral-facing surface 420 while the second aperture 416 can be formed or defined within the rearward-facing surface 418 or a forward-facing surface 422 of the riser 400.

The conduit 412 can be an open channel or passage that extends from one region or area of the riser 400 to another region or area of the riser 400. The conduit 412 can be sized and shaped to receive one or more cables, strings, wires, a combination thereof, or other components. For example, the conduit 412 can be sized and shaped to receive a cable (e.g., one or more of the cables 122, 124) that is operably connected to another component of the archery bow, as described herein with reference to FIGS. 3A-3C. Additionally, or alternatively, the conduit 412 can be sized and shaped to receive a wire or electrical cable (see wire 144) that carries or passes an electrical signal from one region of the riser 400 to another region, as described herein with reference to FIGS. 2B and 2C.

While the respective conduits 212, 312, 412 are shown in respective embodiments in FIGS. 2A-4C, this disclosure contemplates any combination of the conduits 212, 312, 412 utilized within a single riser of an archery bow. Moreover, the specific implementations of conduits 212, 312, 412 shown in FIGS. 2A-4C should not be construed as limiting to the aspects disclosed herein. Rather, the embodiments shown in FIGS. 2A-3C are merely a few example embodiments out of many possible ways to arrange one or more conduits within a riser of an archery bow.

Figure 5:
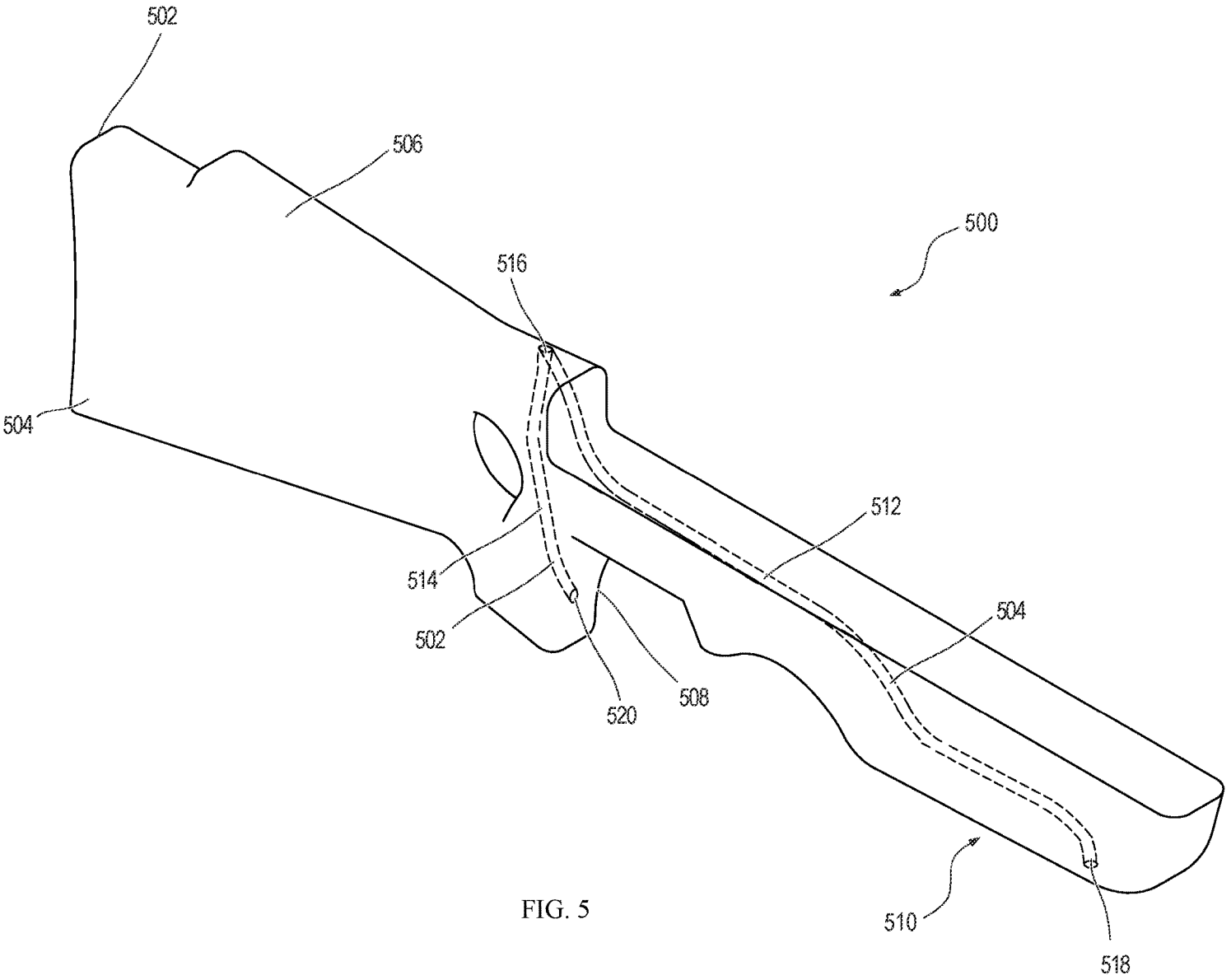
FIG. 5 is a perspective side view of a stock for a crossbow, according to some embodiments.

While FIGS. 1A-4B reference a vertical compound archery bow, aspects of the present disclosure are equally applicable to a riser/and a stock of a crossbow. For example, as shown in FIG. 5, a riser and/or a stock of a crossbow can include one or more conduits such that a string, cable, or wire from an electronic device can be routed into one plane of the riser or stock, through the conduit, and exit the conduit through another plane of the riser or stock. Similarly, aspects of the present disclosure regarding channels (e.g., channel 150) and cavities (e.g., cavities 138, 142, 148) are equally applicable to a riser and/or stock of a crossbow.

FIG. 5 shows a crossbow stock 500 including a heel 502, a toe 504, a comb 506, a grip, 508, and a forend or forstock 510. In some examples, one or more conduits 512, 514 can be disposed within the stock 500. The conduit 512 can extend between a first aperture 516 and a second aperture 518. The first aperture 516 can be formed or defined within a rearward surface of the stock 500 (e.g., nearer the heel 502 than the forstock 510). The second aperture 518 can be formed or defined within the a forward surface of the stock 500 (e.g., nearer the forstock 510 than the heel 502). In some examples, the first aperture 516 and the second aperture 518 can be formed or defined within a similar region of the stock 500. For example, the first aperture 516 and the second aperture 518 can both be formed or defined within the forstock 510 of the stock 500.

The conduit 514 can extend between the first aperture 516 and a third aperture 520. That is, each of the conduits 512, 514 can share a common aperture (e.g., first aperture 516) in some examples. In other examples, the stock 500 can include multiple conduits that do not share a common aperture. The first aperture 516 can be formed or defined within the an upper surface of the stock 500 (e.g., nearer the comb 506 than the grip 508). The third aperture 520 can be formed or defined within the a lower surface of the stock 500 (e.g., nearer the grip 508 than the comb 506).

One or more of the conduits 512, 514 can hide, conceal, and retain at least a portion of the component within the stock 500 to limit interaction between the component and other objects within the shooting environment. For example, the component can be a wire that extends through the conduit from one region of the stock 500 to another region of the stock 500. Some or all of the wire can be housed within the conduit such that the archer's hand does not come into contact with the wire despite the wire extending along the stock 500. In this manner, the wire can be retained within the conduit and limit or prevent the wire from entangling on external objects or causing discomfort to the archer by acting as an obstruction or hindrance to the archer.

While upper, lower, and handle portions of the riser are disclosed herein with reference to a vertical archery bow (e.g., compound and recurve archery bows), a riser or a stock of a crossbow can be equally applicable to aspects of this disclosure. For example, the first, second, and intermediate portions of a riser can be directly correlated with portions of a crossbow stock or riser. Therefore, no descriptive terms herein should be construed as limiting the applicability of the aspects of this disclosure with respect to a crossbow.

In some examples, changes may be made in the function and arrangement of archery components or products discussed without departing from the spirit and scope of the disclosure, and various embodiments may omit, substitute, or add other components or accessories as appropriate. For instance, one or more portions incorporated into a particular component described with respect to certain embodiments may be combined in other embodiments.

Various aspects have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed:

1. A riser for an archery bow, comprising:
- a first portion:
- a second portion; and
- an intermediate portion disposed between the first portion and the second portion, the riser defining a shooting plane intersecting the intermediate portion, the intermediate portion comprising:
  - a first surface defining a first aperture, the first aperture at least partially forming a first cavity within the riser, the first aperture intersecting the shooting plane; and
  - a second surface defining a second aperture, the second aperture at least partially forming a second cavity within the riser, the first cavity and the second cavity in fluid communication to form a path configured to receive a cable.

2. The riser of claim 1, wherein the first surface is a forward-facing surface of the intermediate portion.

3. The riser of claim 1, wherein the second surface is a lateral-facing surface of the intermediate portion.

4. The riser of claim 1, wherein:
- the intermediate portion comprises a third aperture formed within the second surface; and
- the third aperture at least partially forms a third cavity.

5. The riser of claim 4 wherein the second cavity and the third cavity are in fluid communication by the first cavity.

6. The riser of claim 1, wherein the second aperture and the second cavity define a through-hole extending through the intermediate portion.

7. The riser of claim 1, further comprising the cable disposed along the path, the path extending into the first aperture, through the first cavity and the second cavity, and out of the second aperture.

8. The riser of claim 7, wherein the cable is electrically conductive and configured to be used with an electronic accessory device of the archery bow.

9. The riser of claim 1, wherein the intermediate portion comprises a channel formed within the first surface, the channel configured to retain a portion of the cable.

10. An archery bow, comprising:
- a riser comprising a composite material, the riser comprising:
  - an upper portion;
  - a lower portion;
  - a handle portion disposed between the upper portion and the lower portion;
  - a first aperture defined within the upper portion;
  - a second aperture defined within the lower portion; and
  - a conduit formed between the first aperture and the second aperture, the conduit wholly disposed within the riser and extending through the handle portion;
- a first limb coupled to the riser;
- a second limb coupled to the riser; and a bowstring extending between the first limb and the second limb.

11. The archery bow of claim 10, wherein:

the upper portion comprises a first lateral-facing surface and a first rearward-facing surface;

the lower portion comprises a second lateral-facing surface and a second rearward-facing surface;

the first aperture is defined within the first lateral-facing surface or the first reward-facing surface; and the second aperture is defined within the second lateral-facing surface or the second rearward-facing surface.

12. The archery bow of claim 10, wherein:

the upper portion comprises a first lateral-facing surface and a first forward-facing surface;

the lower portion comprises a second lateral-facing surface and a second forward-facing surface;

the first aperture is defined within the first lateral-facing surface or the first forward-facing surface; and the second aperture is defined within the second lateral-facing surface or the second forward-facing surface.

13. The archery bow of claim 10, wherein the conduit is configured to receive at least a portion of an electrically conductive material.

14. The archery bow of claim 10, wherein the composite material comprises carbon fiber.

15. The archery bow of claim 10, wherein the conduit comprises a first section and a second section, the first section extending substantially perpendicular relative to the second section.

16. The archery bow of claim 10, wherein:

the upper portion comprises a first forward-facing surface and a first rearward-facing surface;

the lower portion comprises a second forward-facing surface and a second rearward-facing surface;

the first aperture is defined within the first forward-facing surface or the first rearward-facing surface; and the second aperture is defined within the second forward-facing surface or the second rearward-facing surface.

* * * * *